US005133279A

United States Patent [19]

Dudde et al.

[11] Patent Number: 5,133,279

[45] Date of Patent: Jul. 28, 1992

[54] APPARATUS FOR DRYING A WEB OF TEXTILE MATERIAL

[75] Inventors: Siegfried Dudde, Monchen-Gladbach; Gerhard Voswinckel, Aachen, both of Fed. Rep. of Germany

[73] Assignee: Gebruder Sucker and Franz Muller GmbH & Co., Fed. Rep. of Germany

[21] Appl. No.: 639,912

[22] Filed: Jan. 10, 1991

[30] Foreign Application Priority Data

Jan. 19, 1990 [DE] Fed. Rep. of Germany ..... 4001426

[51] Int. Cl.[5] ..... B05C 11/00

[52] U.S. Cl. ..... 118/60; 118/101; 118/117; 118/118; 118/67; 118/38; 118/68

[58] Field of Search ..... 34/70; 68/20, 175; 118/101, 117, 118, 60, 67, 38, 68

[56] References Cited

U.S. PATENT DOCUMENTS 3,585,821 6/1971 Beltramini ..... 68/175
4,416,124 11/1983 Godau ..... 68/175

FOREIGN PATENT DOCUMENTS 2336518 2/1975 Fed. Rep. of Germany .
3202923A1 8/1983 Fed. Rep. of Germany .

*Primary Examiner*—W. Gary Jones
*Assistant Examiner*—Brenda Lamb
*Attorney, Agent, or Firm*—Shefte, Pinckney & Sawyer

[57] ABSTRACT

A web drying apparatus is provided for a textile machine of the type which is operable to apply a coating or otherwise to wet a web of textile material which is continuously traveled therethrough. The web drying apparatus includes at least a pair of groups of cylindrical drying rollers with each group of rollers being disposed on a respective side of a reference plane. The reference plane is inclined upwardly relative to a nip formed by a pair of squeezing rollers of the wetting device which applies the coating or otherwise wets the textile material. In one embodiment, the drying rollers of one group are disposed in a horizontal plane and the drying rollers of the other group are disposed in a vertical plane. The web drying apparatus additionally includes a device for separating a wet textile web into multiple separate webs. In one embodiment, each separate web travels around the rollers of a respective one of the groups of drying rollers and each separate web travels approximately the same extent from the separating location to the circumferential location on the initial one of the rollers around which it travels.

11 Claims, 4 Drawing Sheets

APPARATUS FOR DRYING A WEB OF TEXTILE MATERIAL

BACKGROUND OF THE INVENTION

The present invention relates to an apparatus for drying a web of textile material and, more particularly, an apparatus for drying a continuously travelling web of textile material following coating or dyeing of the textile material.

The coating or dyeing of the material is typically accomplished by one of a variety of conventionally-known methods such as immersion of the textile material in a liquor bath or spraying of the textile material with a liquid. Following this type of processing of a textile material, which will be hereinafter referred as wetting of the textile material, a controlled drying operation is performed to dry the applied coating or drying material on the textile material to a predetermined degree. Additionally, it is conventionally known to separate a traveling web of textile material into a number of webs prior to or following wetting of the material. For example, German patent document DE A 32 02 923 discloses a device for separating a textile web into two more webs, the device disposed between the device for wetting the textile web and two pairs of heating rollers adapted for applying heat to the two newly-formed webs following wetting of the original textile web to thereby effect drying of the webs. The two heating rollers of each respective pair of heating rollers are arranged in a generally horizontal plane and the two respective pairs of heating rollers are arranged in generally superposed relationship to one another with their horizontal planes parallel to one another.

The two separated webs are guided between the two pairs of heating rollers before each separated web initially engages the first roller of the respective pair of heating rollers around which it travels during the drying process. The two separated webs accordingly travel, without any appreciable support, over a distance of approximately two meters between the nip formed by the squeezing rollers at the wetting device and their respective locations at which the separated webs initially engage a heating roller. This relatively lengthy travel extent of the wet separated webs undesirably creates conditions in which the individual yarns of the separated webs may twist or snarl. Another disadvantage of the arrangement disclosed in the German patent document is that the two pairs of heating rollers, which are arranged after the squeezing rollers relative to the direction of travel of the textile web, require a relatively large amount of space. If one considers the space requirements of the measuring apparatus, squeezing rods, and other devices which are typically disposed between the squeezing rollers and the heating rollers, a total extent of at least 500 millimeters must be reckoned with between the nip of the squeezing rollers and the initial engagement locations on the heating rollers of the separated webs.

An arrangement has also been proposed in which the two pairs of heating rollers are arranged in a common plane above the squeezing rollers. However, since it is desirable that the two separated webs travel generally the same total distance between the nip of the squeezing rollers and their respective initial engagement with the heating rollers so as to avoid uneven drying of the separated webs, it is generally necessary that change of direction rollers be disposed between the nip and the heating rollers to insure that the two separated webs of the textile web travel relatively the same distance. However, the addition of the change of direction rollers adds to the travel extent through which the separated webs travel while being generally unsupported, thereby creating the undesirable conditions mentioned above in which twisting and snarling of individual fibers occurs.

A further proposed arrangement of the heating rollers includes two heating rollers of pair of heating rollers arranged in superposed relation to one another with the two pairs of heating rollers disposed side by side to one another. However, this arrangement disadvantageously increases the height of the web drying apparatus. Moreover, the total unsupported distance over which the separated webs travel in this arrangement can in practice exceed the travel distances traveled by the separated webs handled by the device disclosed in German patent document DE A 32 02 923 discussed above. Additionally, a change of direction roller must typically be disposed between the pair of squeezing rollers and the heating rollers if the pair of squeezing rollers are arranged in superposed relation to one another (i.e., if the textile web travels in a generally horizontal plane through the nip created between the pair of squeezing rollers). Otherwise, the pair of squeezing rollers must be arranged in side by side relation to one another (i.e., the textile web must travel in a vertical plane through the nip formed between the pair of squeezing rollers).

If the textile web is to be separated into four separate webs, it is generally necessary that the textile web be separated into two separate webs before any wetting of the textile web occurs, thereby necessitating the provision of two wetting devices. If the heating rollers are arranged in one of the previously proposed arrangements as discussed above, it can been seen that the space requirements correspondingly increase when a textile web is separated into four instead of two webs and, moreover, the same disadvantages of undesired twisting or snarling of individual yarns still occur. Accordingly, the need exists for an apparatus for drying of a textile web, or other webs separated therefrom, following wetting of the textile web which optimally reduces space requirements and which minimizes the extent to which the textile web or separated web travel in unsupported manner between the nip of the squeezing rollers and their initial engagement with the heating rollers.

SUMMARY OF THE INVENTION

The present invention provides an apparatus for drying a web of textile material which optimally minimizes space requirements through an arrangement of groups of drying rollers in non-parallel relation to one another and disposed on respective sides of a reference plane extending parallel, and upwardly relative to the nip of the squeezing rollers of a wetting station.

Briefly described, the present invention provides, in a textile machine having a wetting means operable to apply a coating or otherwise wet a web of textile material as the web is continuously moved through the textile machine and a pair of squeezing rollers forming a nip therebetween for squeezing the web after wetting thereof by the wetting means, an apparatus for drying the textile web. The web drying apparatus includes a first group of cylindrical drying rollers including at least two rollers each having an axis and a circumferential surface and a second group of cylindrical drying rollers including at least two rollers each having an axis and a circumferential surface.

Each roller of the first and second group of drying rollers is operable to promote drying of the web as the web travels in trained relation therearound, the axis of the two rollers of the first group of drying rollers being disposed in a first roller plane and the axis of the two rollers of the second group of drying rollers being disposed in a second roller plane with the first and second roller planes being in non-parallel relation to one another. Also, the rollers of the first group of drying rollers are disposed on one respective side of a reference plane which extends parallel to the nip and the rollers of the second group of drying rollers being disposed on the other respective side of the reference plane.

The reference plane is inclined upwardly relative to the nip and one roller of at least one of the first and second groups of drying rollers being disposed for initially engaging the web following its travel through the nip and prior to its travel around the other rollers of the at least one group of drying rollers. Finally, in the web drying apparatus, the initially engaging roller is arranged relative to the nip such that the circumferential location at which the web engages the initially engaging roller is disposed upwardly of the nip.

According to one aspect of the present invention, each of the first and second groups of drying rollers includes an initially engaging roller and characterized further by means for separating the textile web into a plurality of separate webs at a separating location downstream of the nip relative to the direction of travel of the textile web for subsequent travel of each separate web onto a respective one of the initially engaging rollers, whereby the textile web travels upwardly from the nip to the separating location and thereafter each of the separate webs travels to its associated initially engaging roller for drying of the separate web by one of the groups of drying rollers.

In a further feature of the one aspect of the present invention, the separating means includes means for separating the textile web into four separate webs at the separating location. Furthermore, the web drying apparatus includes a third group of cylindrical drying rollers and fourth group of cylindrical drying rollers, each of the third and fourth groups of drying rollers having at least two rollers each having an axis and a circumferential surface and each roller of the third and fourth groups of drying rollers being operable to promote drying of a separate web as the separate webs travels in trained relation around the circumferential surface of the roller. The axes of the two rollers of the third group of drying rollers are disposed in a third roller plane and the axes of the two rollers of the fourth group of drying rollers are disposed in a fourth roller plane, the third and fourth roller planes being in non-parallel relation to one another. The rollers of the third group of drying rollers are disposed on one respective side of the reference plane and the rollers of the fourth group of drying rollers being disposed on the other respective side of the reference plane, and each of the groups of drying rollers being operable to promote drying of a respective one of the separate webs.

In the one aspect of the present invention, the extent of travel of each separate web between the nip and the respective initial engaging roller onto which the separate web travels is preferably substantially equal to the travel extents of the other separate webs between the nip and their respective initial engaging rollers.

In the web drying apparatus, the initially engaging roller is preferably spaced relative to the nip such that the travel extent of the textile web between the nip and the circumferential location on the initially engaging roller is of a sufficient length to permit access thereto by measuring apparatus or other devices which require access to the textile web for their operation. Also, in the web drying apparatus, the first roller plane is preferably a horizontal plane and the second roller plane is a vertical plane and the reference plane extends at a 45° angle with respect to the horizontal, whereby the first and second roller planes each form a 45° angle with the reference plane.

In another aspect of the present invention, each of the first and second groups of drying rollers includes an initially engaging roller and the web drying apparatus also includes means for separating the textile web into a plurality of separate webs at a separate location downstream of the nip relative to the direction of travel of the textile web for subsequent travel of each separate web onto a respective one of the initially engaging rollers, whereby the textile web travels upwardly from the nip to the separating location and thereafter each of the separate webs travels to its associated initial engaging roller for drying of the separate web by one of the groups of drying rollers, each separate web engaging its associated initially engaging roller at a circumferential location thereon and the circumferential locations of the pair of initially engaging rollers being spaced substantially equidistant from the reference plane.

In the web drying apparatus of the present invention, there is preferably provided a group of cylindrical end drying rollers for end drying of the textile web, the uppermost ones of the end drying rollers each having an axis generally positioned in the first roller plane.

In the another aspect of the present invention, the web drying apparatus also includes a guide roller disposed for guiding the separate webs following the respective travel of each separate web around the respective group of drying rollers for drying of the separate web, and an additional group of cylindrical drying rollers having at least two rollers each having an axis and a circumferential surface. The separate webs are guided at the guide roller into superposed, touching relationship as a single textile web and the rollers of the additional group of drying rollers being disposed downstream of the guide roller for promoting drying the single textile web.

In another aspect of the present invention in which the textile machine includes a pre-wetting separating means for separating the textile web into a pair of webs at a location downstream of the wetting means relative to the direction of travel of the textile web and a second pair of squeezing rollers forming a nip therebetween, the wetting means being operable to individually wet each one of the pair of webs and one of the pair of webs traveling through the first mentioned pair of squeezing rollers following wetting of the one web and the other of the pair of webs traveling through a second nip formed by the other pair of squeezing rollers following wetting of the other web, the first and second group of drying rollers are operable to promote drying of the one web following wetting thereof and the web drying apparatus includes a third group of cylindrical drying rollers and a fourth group of cylindrical drying rollers, each of the third and fourth groups of drying rollers having at least two rollers each having an axis and a circumferential surface.

Each roller of the third and fourth groups of drying rollers is operable to promote drying of the other web following wetting thereof as the other web travels in trained relation around the circumferential surface of the roller, the axes of the two rollers of the third group of drying rollers are disposed in a third roller plane and the axes of the two rollers of the fourth group of drying rollers being disposed in a fourth roller plane. The third and fourth roller planes are in non-parallel relation to one another.

Also, in the further aspect of the present invention, the rollers of the third group of drying rollers are disposed on one respective side of a second reference plane which extends parallel to the second nip of the other pair of squeezing rollers through which the other web travels and the rollers of the fourth group of drying rollers being disposed on the other respective side of the second reference plane. The second reference plane is inclined upwardly relatively to the second nip and one roller of at least one of the third and fourth groups of drying rollers being disposed for initially engaging the other web following its travel through the second nip and prior to its travel around the other rollers of the at least one of the third and fourth groups of drying rollers, the second mentioned initially engaging roller being arranged relative to the second nip such that the circumferential location of the second mentioned initially engaging roller at which the other web engages the second mentioned initially engaging roller is disposed upwardly of the second nip.

In another feature of the further aspect of the present invention, each of the groups of drying rollers includes an initially engaging roller for initially engaging a web prior to travel of the web around the other rollers of the respective group of drying rollers and the web drying apparatus includes first means for separating the one web into another pair of webs at a first separating location between the first nip and the initially engaging rollers of the first and second groups of drying rollers for subsequent travel of each one of the another pair of webs onto a respective one of the initially engaging rollers of the first and second of drying rollers and second means for separating the other web into a further pair of webs at a second separating location between the second nip associated with the third and fourth groups of drying rollers and the initially engaging rollers of the third and fourth groups of drying rollers for subsequent travel of each web of the further pair of webs onto a respective one of the initially engaging rollers of the third and fourth groups of drying rollers. The pair of webs each travel upwardly from the respective nip through which it passes to the respective separating location at which it is separated into the another pair of webs or the further pair of webs and thereafter each of the four webs of the another pair of webs and the further pair of webs travels from its respective separating location to its associated initially engaging roller for drying of the web by a respective one of the groups of drying rollers.

DESCRIPTION OF THE PREFERRED EMBODIMENT

Figure 1:
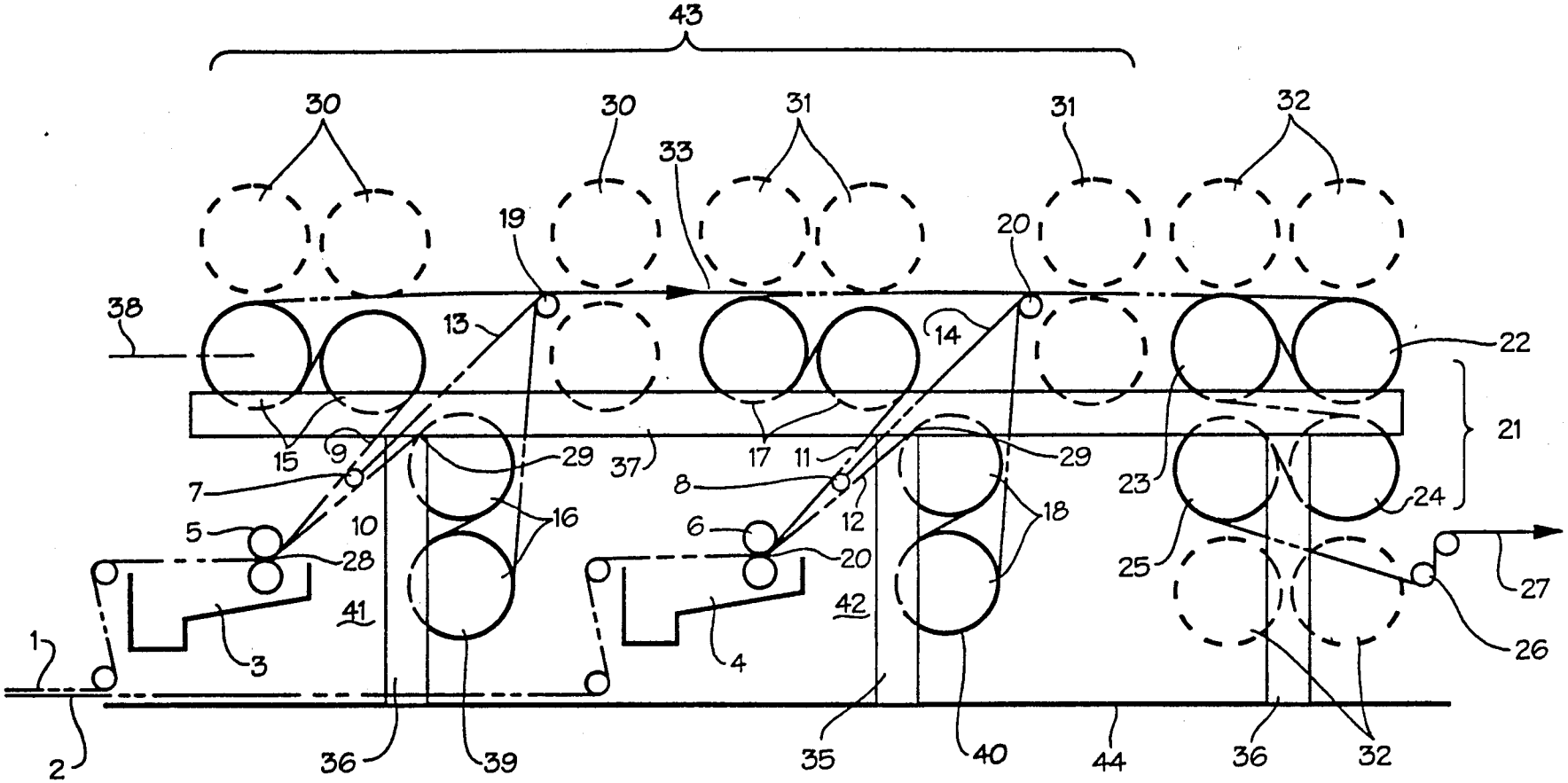
FIG. 1 is a schematic front elevational view of one embodiment of the textile web drying apparatus of the present invention.

In FIG. 1, one embodiment of the web drying apparatus of the present invention is illustrated in its operating disposition in a textile machine of the type adapted for applying a coating or dye to a web of textile material. The web drying apparatus of the present invention is adapted to dry a textile web following the application of a coating or dye thereto by a conventional coating or dye applying means.

The textile machine in which the web drying apparatus shown in FIG. 1 is operatively installed is more specifically operable to apply a coating, dye, or other liquid substance to a continuously traveling textile web (hereinafter commonly referred to as "wetting the textile web") by any one of a number of conventional application means such as, for example, through movement of the textile web through a dye or liquor bath or spraying of liquid onto the textile web. Moreover, the textile machine is operable to separate a textile web, at a downstream location (not shown), into a pair of webs 1,2, thereafter individually wet and subsequently dry each web 1,2 at a pair of wetting stations 41,42, respectively, and then reunite the webs 1,2 in superposed, touching relation with one another for further processing.

The wetting station 41 includes conventional wetting means for individually wetting the web 1 in the form of a conventional bath 3, and a pair of squeezing rollers 5. As schematically shown in FIG. 1, after the webs 1,2 have been separated from each other at the downstream separation location (not shown), the web 1 travels around various guide rollers, thereafter through the bath 3,4, and upon exiting the bath, through a nip 28 formed by the pair of squeezing rollers 5.

After the web 1 passes through the nip formed by the pair of squeezing rollers 5, the web travels further into engagement with a first separating means. The first separating means includes a conventional wet dividing rod 7 for separating the web 1, after its passage through the squeezing roller nip 28 into another pair of webs 9,10. The pair of webs 9,10 thereafter travel through the web drying apparatus of the present invention for drying the webs 9,10. The web drying apparatus is advantageously configured to optimally minimize the space required therefor and to insure that the webs 9,10 do not travel over excessively lengthy extents without support so as to minimize the risk that individual fibers will twist or snarl. The web drying apparatus includes a first group of cylindrical drying rollers comprising two rollers 15, each having an axis, and a second group of cylindrical drying rollers comprising two rollers 16, each having an axis. Each roller of the first and second groups of drying rollers is operable to promote drying of a web as the web travels in trained relation therearound. The axes of the two rollers 15 of the first group of drying rollers are disposed in a horizontal first roller plane 38 and the axes of the two rollers 16 of the second group of drying rollers are disposed in a vertical second roller plane 39. The rollers 15 of the first group of drying rollers are disposed on one respective side of a reference plane 13 which extends parallel to the nip 28 formed by the pair of squeezing rollers 5 and the rollers 16 of the second group of drying rollers are disposed on the other respective side of the reference plane 13. The reference plane 13 is inclined upwardly relative to the nip 28 at preferably a 45° angle with respect to the horizontal. The first roller plane 38 and the second roller plane 39 each form a 45° angle with the reference plane 13.

One roller 15 of the first group of drying rollers and one roller 16 of the second group of drying rollers is disposed for initially engaging the web 9,10, respectively, following travel of the web 1 beyond the nip 28 and prior to the travel of the web 9,10, respectively, around the other rollers of the respective group of drying rollers. The initially engaging rollers 15,16 are arranged with their axes substantially equi-distant from the nip 28 and substantially equi-distant diagonally oriented reference plane 13. This insures that the webs 9,10 travel over substantial equal extents between the wet dividing rod 7 and the respective initially engaging rollers 15,16 so that the risk of uneven drying of the webs 9,10 with respect to one another is minimized.

The web 9,10 initially engages the initially engaging roller 15,16, respectively, on a circumferential location thereon such as, for example, the circumferential location 29 on the initially engaging roller 16. The initially engaging rollers 15,16 are arranged such that the respective circumferential locations at which the web 9,10, respectively, initially engages the roller is disposed upwardly of the nip 28.

The web 9,10 travels in trained relation around the initially engaging roller 15,16, respectively, and thereafter travels around the other roller 15,16, respectively, of the respective group of drying rollers. As the web 9,10 travels around the drying rollers, the drying rollers promote drying of the web and to this end, the rollers 15,16 can be configured as conventional cylindrical heating rollers operable, for example, to apply heat through their circumferential surfaces to heat the web in contact therewith.

The wetting station 42 includes conventional wetting means for individually wetting the web 1 in the form of a conventional bath 3, and a pair of squeezing rollers 6. As schematically shown in FIG. 1, after the webs 3,4 have been separated from each other at the downstream separation location (not shown), the web 1 travels around various guide rollers, thereafter through the bath 3,4, and upon exiting the bath, through a nip 28 formed by the pair of squeezing rollers 6.

After the web 1 passes through the nip formed by the pair of squeezing rollers 6, the web travels further into engagement with a third separating means. The third separating means includes a conventional wet dividing rod 8 for separating the web 1, after its passage through the squeezing roller nip 28 into another pair of webs 11,12. The pair of webs 11,12 thereafter travel through the web drying apparatus of the present invention for drying the webs 11,12. The web drying apparatus is advantageously configured to optimally minimize the space required therefor and to insure that the webs 11,12 do not travel over excessively lengthy extents without support so as to minimize the risk that individual fibers will twist or snarl. The web drying apparatus includes a third group of cylindrical drying rollers comprising two rollers 17, each having an axis, and a fourth group of cylindrical drying rollers comprising two rollers 18, each having an axis. Each roller of the third and fourth groups of drying rollers is operable to promote drying of a web as the web travels in trained relation therearound. The axes of the two rollers 17 of the third group of drying rollers are disposed in a horizontal third roller plane 38 and the axes of the two rollers 18 of the fourth group of drying rollers are disposed in a vertical fourth roller plane 40. The rollers 17 of the third group of drying rollers are disposed on one respective side of a reference plane 14 which extends parallel to the nip 28 formed by the pair of squeezing rollers 6 and the rollers 18 of the fourth group of drying rollers are disposed on the other respective side of the reference plane 14. The reference plane 14 is inclined upwardly relative to the nip 28 at preferably a 45° angle with respect to the horizontal. The third roller plane 38 and the fourth roller plane 40 each form a 45° angle with the reference plane 14.

One roller 17 of the third group of drying rollers and one roller 18 of the fourth group of drying rollers is disposed for initially engaging the web 11,12, respectively, following travel of the web 1 beyond the nip 28 and prior to the travel of the web 11,12, respectively, around the other rollers of the respective group of drying rollers. The initially engaging rollers 17,18 are arranged with their axes substantially equidistant from the nip 28 and substantially equidistant diagonally oriented reference plane 14. This insures that the webs 11,12 travel over substantial equal extents between the wet dividing rod 8 and the respective initially engaging rollers 17,18 so that the risk of uneven drying of the webs 11,12 with respect to one another is minimized.

The web 11,12 initially engages the initially engaging roller 17,18, respectively, on a circumferential location thereon such as, for example, the circumferential location 29 on the initially engaging roller 18. The initially engaging rollers 17,18 are arranged such that the respective circumferential locations at which the web 11,12, respectively, initially engages the roller is disposed upwardly of the nip 28.

The web 11,12 travels in trained relation around the initially engaging roller 17,18, respectively, and thereafter travels around the other roller 17,18, respectively, of the respective group of drying rollers. As the web 11,12 travels around the drying rollers, the drying rollers promote drying of the web and to this end, the rollers 17,18 can be configured as conventional cylindrical heating rollers operable, for example, to apply heat through their circumferential surfaces to heat the web in contact therewith.

Following their travel around their respective associated group of drying rollers, the webs 9-12 are traveled longitudinally further along the textile machine, with the webs 9,10 being trained a guide roller 19, and the webs 11,12 being trained around a guide roller 20 to an end drying apparatus 21. The end drying apparatus 21 includes a plurality of conventional cylindrical drying rollers 22-25, and the four webs 9-12, which have been disposed in superposed, touching relation with one another to again form a single textile web, are subjected to drying action by the drying rollers 22-25 as they are traveled as a single textile web around the heating rollers. Thereafter, the reconstructed single textile web is traveled around a guide roller 26 and exits the textile machine as a finished dried textile web 27 suitable for further handling at another location such as, for example, at a warp beam (not shown).

In one variation of the web drying apparatus shown in FIG. 1, two additional pairs of drying rollers 31 and an additional pair of rollers 31 can be provided to further promote the drying of the webs 9,10 and a second pair of additional drying rollers 31 and an additional pair of end drying rollers 32 can be provided to further promote the drying of the webs 9-12 after the webs have been reunited into a single textile web prior to travel of the single textile web over the end drying rollers 22-25. One pair of the additional drying rollers 30 are arranged with their axes in a horizontal plane parallel to the first roller plane 38 and the axis of each additional roller is vertically aligned with the axis of a respective one of the rollers 15 of the first group to the top surface of the web 9 as it travels from the last of the rollers 15 toward the guide roller 19 at which it is reunited in superposed, touching relation with the web 10.

The other additional pair of drying rollers 30 are arranged with their axes in a vertical plane and forming a heating nip therebetween through which the reunited webs 9,10 travel following their passage over the guide roller 19. One pair of the additional drying rollers 31 are arranged with their axes in a horizontal plane and with each axis in vertical alignment with an axis of a respective one of the rollers 17 of the third group of drying rollers. The other pair of additional drying rollers 31 are arranged with their axes in vertical alignment with one another to form a heating nip therebetween through which the reunited webs 9-12 travel after their passage over the guide roller 20. The additional pair of end drying rollers 32 are arranged with their axes in a horizontal plane with each axis in vertical alignment with the axis of a respective one of the end drying rollers 22,23.

In the variation of the web drying apparatus including the additional pairs of rollers 30-32, all of the rollers 15-18, the end rollers 22-25, and the additional pairs of rollers 30-32 are supported by a structure which includes three vertical columns 34,35 and 36 spaced longitudinally from one another and a truss member 37 connected to the top of each of the vertical columns 34-36 and extending longitudinally beyond the vertical column 34 on one side and the vertical column 36 on the other side. Appropriate structural members (not shown) are provided to support the respective individual rollers from the frame arrangement comprises of the vertical columns 34-36 and the tress member 37.

The first roller plane 38 and the second roller plane 39 accordingly form a right angle within which the wetting means including its bath 3 and the pair of squeezing rollers 5 are arranged. The third roller plane and the fourth roller plane 40 together form a right angle within which the respective wetting means including its bath 4 and the pair of squeezing rollers 6 are arranged. The drying rollers 15 of the first group of drying rollers, the drying rollers 17 of the third group of drying rollers, and the lowermost roller of the second additional pair 31 of rollers, all of which are disposed in the horizontal plane defined by the first roller plane 38 and collectively referred by the number 43, are preferably disposed at generally the same height above the floor 44 as the rollers 22,23 of the group of end drying rollers 21.

The groups of rollers associated with each bath and its complementary pair of squeezing rollers are accordingly arranged with one group of drying rollers being disposed on one side of a diagonally oriented reference plane with the axes of the drying rollers of that group in a horizontal plane and another group of the drying rollers disposed on the other side of the diagonally oriented referenced plane with the axes of the drying rollers being disposed in a vertical plane. This arrangement optimally minimizes the relative distance of the drying rollers from the pair of squeezing rollers through which the web travels immediately before traveling around the drying rollers while providing a sufficient travel extent of the textile web between the squeezing roller nip and the initially engaging rollers for the installation of equipment.

For example, apparatus for measuring and detecting characteristics of the textile web, wet dividing members, and other commonly installed components can be mounted adjacent the textile web in the extent of the web between the squeezing roller nip and the circumferential locations at which the webs 9,10 initially engage the initially engaging rollers of the first and second groups of drying rollers such that these components can be readily accessed. Additionally, the space between the two respective groups of drying rollers associated with each wetting means such as, for example, the space between the first group of drying rollers 15 and the second group of drying rollers 16, is relatively limited that the risk of a premature drying of the textile web during periods when the textile machine is not operating (and the web is therefore not traveling continuously therethrough) is effectively minimized.

It can be further appreciated that the arrangement of the respective group of drying rollers on the side of each wetting station (e.g., the second group of drying rollers 16 and the fourth group of drying rollers 18) optimally minimizes the spacing which can be achieved between each adjacent wetting station since the drying rollers in these groups of drying rollers are in superposed relation with one another. In other words, the longitudinal extent of the groups of drying rollers in the spaces between each pair of adjacent wetting stations is effectively only the diameter of a single drying roller. In like manner, the arrangement of the respective groups of drying rollers which are above the wetting stations such as, for example, the first group of drying rollers 15 and the third group of drying rollers 17, optimally minimizes the total height of each wetting station since the rollers in these respective groups of drying rollers are arranged in a horizontal plane. Thus, the web drying apparatus of the present invention optimally minimizes the cumulative extent to which a web travels in a wet condition following wetting thereof at a wetting station while also advantageously minimizing the overall height and longitudinal extent of each wetting station.

As illustrated by the variation of the web drying apparatus which includes the additional pairs of drying rollers 30,31 and the additional pair of end drying rollers 32, the web drying apparatus of the present invention provides the flexibility to expand the number of drying rollers in operation on a textile machine without significantly increasing the overall height and longitudinal extent of the textile machine. For example, the addition of the two pairs of additional drying rollers 30, the two pairs of additional pairs of drying rollers 31, and the two pairs of additional end drying rollers 32 double the total number of drying rollers in operation on the textile machine illustrated in FIG. 1 from six pairs of drying rollers to twelve pairs of drying rollers. In fact, it is possible to provide additional pairs of drying rollers to the six basic pairs of drying rollers to achieve a total number of drying roller pairs of between fourteen and twenty-four without exceeding the overall height and longitudinal dimensions of a typical conventional textile machine of this type.

In the event that the overall height of the wetting means at the wetting stations extends the overall height of the wetting stations to such a degree that it is not possible to add additional pairs of drying rollers to the top of the textile machine such as, for example, the additional pairs of drying rollers 30, the space saving advantages of the web drying apparatus of the present invention still permit compact configurations of the textile machine. For example, two or three pairs of end drying rollers can be provided immediately adjacent the respective group of drying rollers at the endmost wetting station such as, for example, immediately adjacent the fourth group of drying rollers 18, to thereby achieve a relatively compact textile machine having twelve or fourteen drying rollers for the drying of a textile web which has been separated into a plurality of separate webs.

Figure 2:
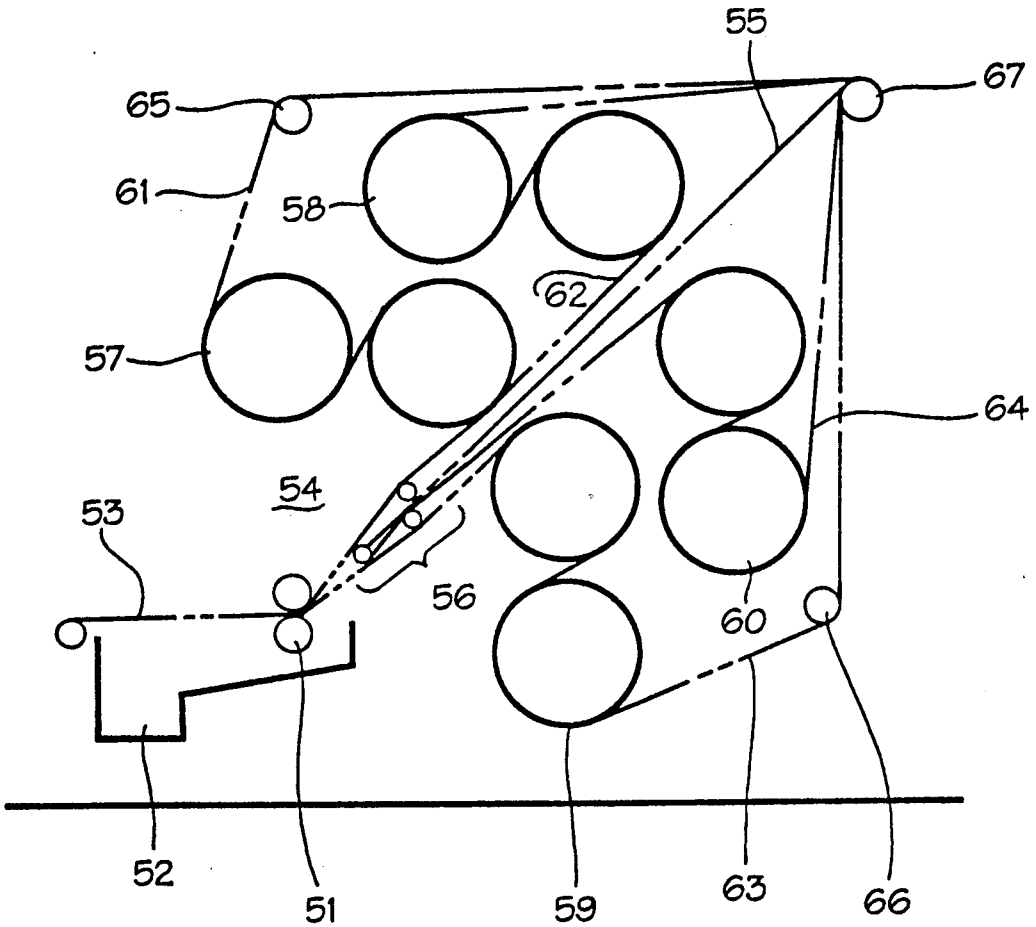
FIG. 2 is a schematic front elevational view of another embodiment of the textile web drying apparatus of the present invention.

FIG. 2 illustrates another embodiment of the web drying apparatus of the present invention adapted for drying the four webs which have been individually separated from a single textile web which has been wetted by the wetting means of a wetting station. Although only a single wetting station is illustrated in FIG. 2, it is to be understood that other similarly configured wetting stations can be provided such as in the manner illustrated with respect to the embodiment of the web drying apparatus shown in FIG. 1 so that a complete textile machine for wetting and drying a web of textile material can be provided.

In the wetting station illustrated in FIG. 2, a single textile web 3 is wetted in a bath 52 and is then squeezed in the nip formed by a pair of squeezing rollers 51. The web drying apparatus includes a first group of drying rollers 57 having their axes disposed in a horizontal plane and disposed on one respective side of a reference plane 55, a second group of drying rollers 59 having their axes disposed in a vertical plane and disposed on the other side of the reference plane 55, a third group of drying rollers 58 having their axes disposed in a horizontal plane parallel to and above the plane in which the first group of drying rollers 57 are disposed. The third group of drying rollers 58 are disposed on the same respective side of the reference plane 55 as the first group 57 of drying rollers. The web drying apparatus also includes a fourth group of drying rollers 60 having their axes disposed in a vertical plane parallel to and longitudinally offset from the vertical plane in which the axes of the rollers of the second group of drying rollers 59 are disposed. The fourth group of drying rollers 60 are disposed on the same respective side of the reference plane 55 as the rollers of the second group of drying rollers 59. Each group of drying rollers 57–60 is operable to dry a web 61–64, respectively, which is created by the separation of the single textile web 53 by separating means 56 following the travel of the single textile web 53 through the nip formed by this pair of squeezing rollers 51. Following their individual drying by the respective associated group of drying rollers 57–60, the webs 61–64 are commonly trained around a guide roller 67 and are traveled further in superposed, touching relation to an end drying roller station such as, for example, the group of end drying rollers 21 illustrated in FIG. 1.

Figure 3:
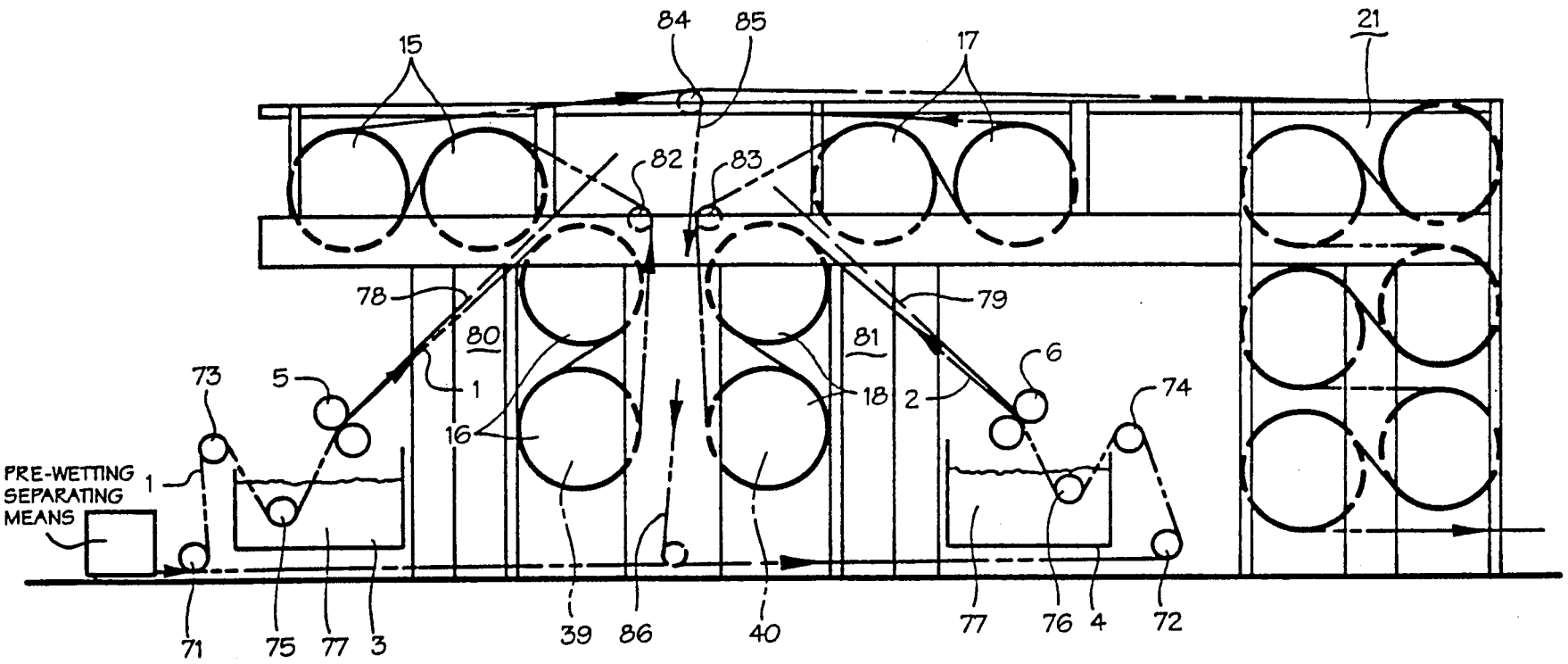
FIG. 3 is a schematic front elevational view of a further embodiment of the textile web drying apparatus of the present invention.

In FIG. 3, a further embodiment of the web drying apparatus of the present invention is illustrated in its installed disposition on a textile machine similar to the textile machine described with respect to the embodiment illustrated in FIG. 1 to the extent that the textile machine is operable to apply a coating or dye to a continuously moving web of textile material and includes means for separating a textile web at a downstream location into a pair of webs 1,2 where individual travel of the webs through a pair of wetting stations 80,81 and operable to thereafter reunite the webs 1,2 in superposed, touching relationship with one another for end drying a group of end drying rollers 21.

The web 1 travels in trained relation around a pair of guide rollers 71,73 to the wetting station 80 at which a wetting means including a bath 3 and a pair of squeezing rollers 5 are disposed for wetting of the web 1. An immersion roller 75 is disposed in the liquor 77 of the bath 3 for guiding the web 1 beneath the surface of the liquor bath 3 to effect immersion wetting of the web 1. After its immersion in the liquor 77 of the bath 3, the now wet web 1 travels through the nip formed by the pair of squeezing rollers 5. The web drying apparatus includes a first group of cylindrical drying rollers including a pair of rollers 15 and a second group of cylindrical drying rollers including a pair of rollers 16. Each of the rollers 15,16 has an axis and a circumferential surface and each roller is operable to promote drying of the web 1 as the web travels in trained relation about the circumferential surface of the roller. The axes of the two rollers 15 of the first group of drying rollers are disposed in a horizontal first roller plane and the axes of the two rollers 16 of the second group of drying rollers are disposed in a vertical second roller plane 39. The rollers 15 of the first group of drying rollers are disposed on one respective side of a reference plane 78 which extends parallel to the nip formed by the pair of squeezing rollers 5 and the rollers 16 of the second group of drying rollers are disposed on the other respective side of the reference plane 7,8. The reference plane 78 is inclined upwardly relative to the nip at preferably a 45° angle with respect to the horizontal. The first roller plane and the second roller plane 39 each form a 45° angle with the reference plane 78.

The uppermost roller 16 of the second group of drying rollers is disposed for initially engaging the web 1 following travel of the web 1 beyond the nip and prior to the travel of the web around the other roller 16 of the second group of drying rollers and the rollers 15 of the first group of drying rollers. The web 1 travels from the nip to the initially engaging roller 16 of the second group of drying rollers and thereafter sequentially travels in trained relation over the other roller 16 of the second group of drying rollers, a guide roller 82, the respective roller 15 of the first group of drying rollers closest to the reference plane 7,8, the other roller 15 of the first group of drying rollers, and thereafter over a guide roller 84 disposed upwardly of the rollers 15 of the first group of drying rollers and longitudinally beyond the wetting station 80.

The web 2 travels in trained relation around the guide roller 71 and another pair of guide rollers 72,74 before entering the wetting station 81. The wetting station 81 includes a wetting means having a bath 4 retaining a quantity of liquor 77 and a pair of squeezing rollers 6 forming a nip therebetween. An immersion roller 76 is supported in the bath 4 under the surface of the liquor 77 and is operable to guide the web 2 under the surface of the liquor 77 following travel of the web over the guide roller 74. The web drying apparatus includes a third group of cylindrical drying rollers comprising two rollers 17 and a fourth group of cylindrical drying rollers comprising two rollers 18. Each roller of the third and fourth groups of drying rollers is operable to promote drying of the web as the web travels in trained relation therearound. The axes of the two rollers 17 of the third group of drying rollers are disposed in the same horizontal plane as the first roller plane and the axes of the two rollers 18 of the fourth group of drying rollers are disposed in a vertical fourth roller plane 40. The roller 17 of the third group of drying rollers are disposed on one respective side of a reference plane 79 which extends parallel to the nip formed by the pair of squeezing rollers 6 and the rollers 18 of the fourth group of drying rollers are disposed on the other respective side of the reference plane 79.

The reference plane 79 is inclined upwardly relative to the nip formed by the pair of squeezing rollers 6 at preferably a 45° angle with respect to the horizontal and the reference plane intersects the reference plane 78 of the wetting station 80 at a right angle. The roller plane of the roller 17 of the third group of drying rollers and the fourth roller plane 40 each form a 45° angle with the reference plane 79.

One roller 18 of the fourth group of drying rollers is disposed for initially engaging the web 2 following travel of the web 2 beyond the nip formed by the pair of squeezing rollers 6 and prior to travel of the web around the other roller 18 of the fourth group of drying rollers and the rollers 17 of the third group of drying rollers. The initially engaging roller 18 is arranged such that its circumferential surface is relatively closely adjacent the reference plane 79 so that the web 2 engages the circumferential surface of the initially engaging roller 18 at a location at an offset of relatively few degrees from the reference plane 79. The web 2 sequentially travels around the initially engaging roller 18, the other roller 18 of the fourth group of drying rollers, a guide roller disposed upwardly of the initially engaging roller 18 and longitudinally intermediate the wetting station 80 and the wetting station 81, and thereafter over the roller 17 of the third group of drying rollers. After its travel around the second roller 17 of the third group of drying rollers, the web 2 travels around the guide roller 84 and is thereafter disposed in superposed, touching relation with the web 1 for travel as a single textile web to the end drying rollers of the group of end drying rollers 21 for further drying of the textile web.

The web drying apparatus in the embodiment illustrated in FIG. 3 are accordingly operably to guide the webs 1,2 in diagonal directions relative to the respective nips which are at generally the same respective inclination as the respective reference planes 78,79.

The configuration of the pair of web drying apparatus shown in the embodiment illustrated in FIG. 3 advantageously permits space saving flexibility in that the two groups of drying rollers disposed in vertical planes—the second group of drying rollers 16 and the fourth group of drying rollers 18—are arranged relatively close and adjacent one another.

The travel path of the web 1 through the textile machine illustrated in FIG. 3 can be modified to permit variations in the wetting and drying of the web by the textile machine. For example, the web 1 can be guided around a guide roller 84 to one of the rollers 18 of the fourth groups of drying rollers after the web 1 has initially been subjected to drying action by the first and second groups of drying rollers. In this modification, the web 1 travels as well over the drying rollers 18 of the fourth group of drying rollers and roller 17 of the third group of drying rollers to effect further drying of the web. In another modification of the travel path of the textile web 1, the textile web 1 can be guided from the guide roller 84 to the guide roller 86 for disposing the textile web 1 in superposed, touching relation with the textile web 2 along the travel path of the textile web 2 en route to the wetting station 81. In this modification of its travel path, the textile web 1 is accordingly subjected to a further wetting after its initially wetting at the wetting station 80 as it travels in superposed, touching relation with the web 2 through the wetting station 81.

Figure 4:
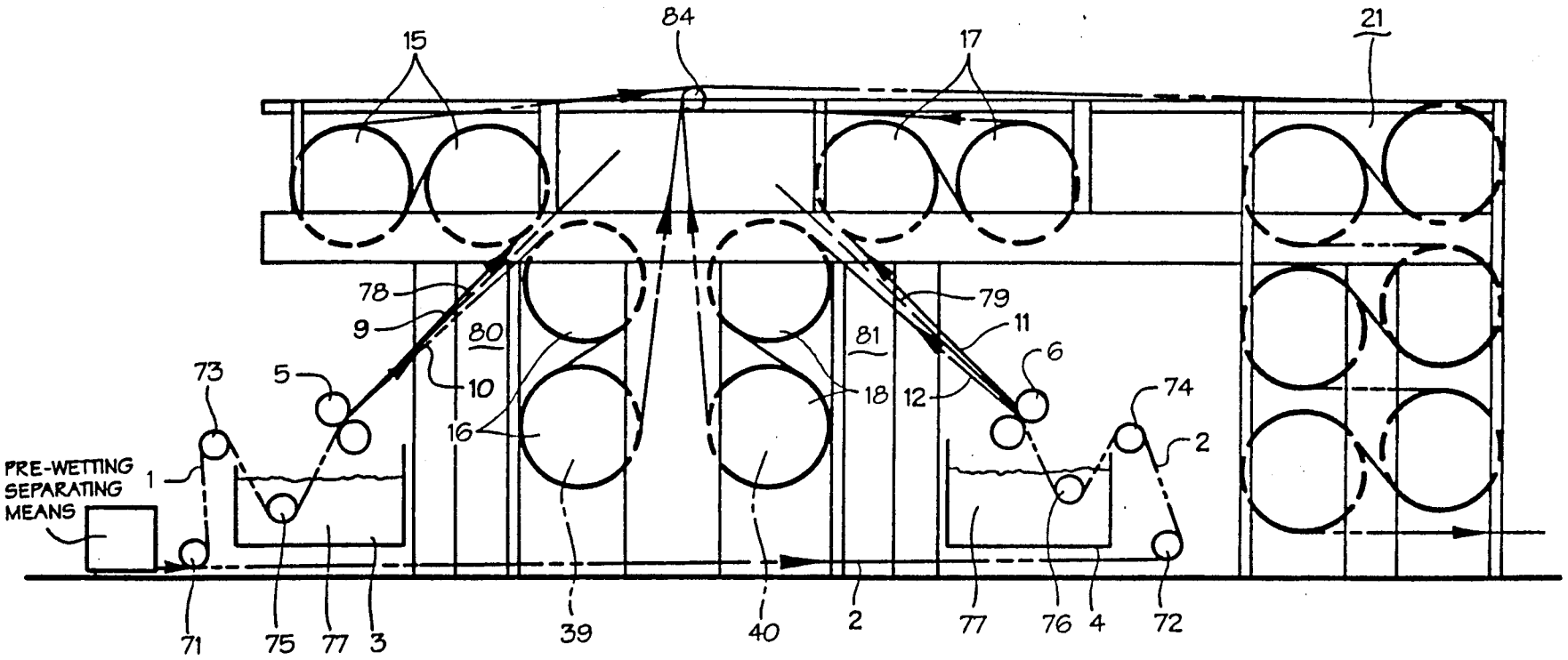
FIG. 4 is schematic front elevational view of an additional embodiment of the textile web drying apparatus of the present invention.

In FIG. 4, a variation of the further embodiment of FIG. 3 is illustrated. The textile machine in the variation illustrated in FIG. 4 includes a pair of post wetting separating means, each operatively disposed at a respective one of the wetting stations 80,81. The post wetting separating means at the wetting station 80 is operable to separate the web 1 into a pair of webs 9,10 at a location downstream of the squeezing rollers 5 relative to the direction of travel of the web 1. The respective roller of each of the first and second groups of drying rollers which is most closely adjacent the reference plane 79 is operable as an initially engaging roller for initially engaging the web 9,10, respectively. The web 9 travels in trained relation about the pair of rollers 15 of the first group of drying rollers and the web 10 travels in trained relation around the rollers 16 of the second group of drying rollers.

The post wetting separating means at the wetting station 81 separates the web 2 into a pair of webs 11,12 at a location downstream the pair of squeezing rollers 6 relative to the direction of travel of the web 2. The respective roller of each of the third and fourth groups of drying rollers most closely adjacent the web 9 are operable as initially engaging rollers for initially engaging a respective one of the webs 11,12 after separation thereof from the other web. The web 11 travels in trained relation around the roller 17 of the third group of drying rollers and the web 12 travels in trained relation of the rollers 18 of the fourth group of drying rollers. The webs 9–12 are each guided around a guide roller 84 following the completion of their travel around the respective associated group of drying rollers for drying the web and these four webs are united in superposed, touching relation into a single textile web, which is traveled to the end drying rollers of the group of end drying rollers 21 for further drying.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile machine having a wetting means operable to apply a coating or otherwise wet a web of textile material as the web is continuously moved through the textile machine and a pair of squeezing rollers forming a nip therebetween for squeezing the web after wetting thereof by the wetting means, an apparatus for drying the textile web comprising:

a first group of cylindrical drying rollers including at least two rollers each having an axis and a circumferential surface; and a second group of cylindrical drying rollers including at least two rollers each having an axis and a circumferential surface;

each roller of said first and second group of drying rollers being operable to promote drying of the web as the web travels in trained relation therearound, the axes of said at least two rollers of said first group of drying rollers being disposed in a first roller plane and the axis of said at least two rollers of said second group of drying rollers being disposed in a second roller plane with said first and second roller planes being in non-parallel relation to one another, the rollers of said first group of drying rollers being disposed on one respective side of a reference plane which extends parallel to the nip and said rollers of said second group of drying rollers being disposed on the other respective side of said reference plane, each of said first and second roller planes being in non-parallel relation to said reference plane whereby a respective one roller of each of said first and second groups of drying rollers is located closer to said reference plane than the other rollers of the respective group of drying rollers, said reference plane being inclined upwardly relative to the nip and at least one of said rollers located closer to said reference plane than the other rollers in its respective group of drying rollers being disposed for initially engaging the web following its travel through the nip and prior to its travel around the other rollers of the respective group of drying rollers, said initially engaging roller being arranged relative to the nip such that the circumferential location at which the web engages said initially engaging roller is disposed upwardly of the nip.

2. In a textile machine, the web drying apparatus according to claim 1 and further comprising means for separating the textile web into a plurality of separate webs at a separating location downstream of the nip relative to the direction of travel of the textile web for subsequent travel of each separate web onto a respective one of said initially engaging rollers, whereby the textile web travels upwardly from the nip to the separating location and thereafter each of the separate webs travels to its associated initially engaging roller for drying of the separate web by one of said groups of drying rollers.

3. In a textile machine, the web drying apparatus according to claim 2 and wherein said separating means includes means for separating the textile web into four separate webs at said separating location and further comprising a third group of cylindrical drying rollers and fourth group of cylindrical drying rollers, each of said third and fourth groups of drying rollers having at least two rollers each having an axis and a circumferential surface, each roller of said third and fourth groups of drying rollers being operable to promote drying of a separate web as the separate webs travels in trained relation around the circumferential surface of the roller, the axes of the two rollers of said third group of drying rollers being disposed in a third roller plane and the axes of the two rollers of said fourth group of drying rollers being disposed in a fourth roller plane, said third and fourth roller planes being in non-parallel relation to one another, the rollers of said third group of drying rollers being disposed on one respective side of said reference plane and the rollers of said fourth group of drying rollers being disposed on the other respective side of said reference plane, and each of said groups of drying rollers being operable to promote drying of a respective one of the separate webs.

4. In a textile machine, the web drying apparatus according to claim 2 and wherein the extent of travel of each separate web between the nip and the respective initial engaging roller onto which the separate web travels is substantially equal to the travel extents of the other separate webs between the nip and their respective initial engaging rollers.

5. In a textile machine, the web drying apparatus according to claim and wherein said initially engaging roller is spaced relative to the nip such that the travel extent of the textile web between the nip and said circumferential location on said initially engaging roller is of a sufficient length to permit access thereto by measuring apparatus or other devices which require access to the textile web for their operation.

6. In a textile machine, the web drying apparatus according to claim 1 and wherein said first roller plane is a horizontal plane and said second roller plane is a vertical plane and said reference plane extends at a 45° angle with respect to the horizontal, whereby said first and second roller planes each form a 45° angle with said reference plane.

7. In a textile machine, the web drying apparatus according to claim 1 and further comprising means for separating the textile web into a plurality of separate webs at a separate location downstream of the nip relative to the direction of travel of the textile web for subsequent travel of each separate web onto a respective one of said initially engaging rollers, whereby the textile web travels upwardly from the nip to the separating location and thereafter each of the separate webs travels to its associated initial engaging roller for drying of the separate web by one of said groups of drying rollers, each separate web engaging its associated initially engaging roller at a circumferential location thereon and said circumferential locations of said pair of initially engaging rollers being spaced substantially equidistant from said reference plane.

8. In a textile machine, the web drying apparatus according to claim 7 and further comprising a guide roller disposed for guiding the separate webs following the respective travel of each separate web around the respective group of drying rollers for drying of the separate web, and an additional group of cylindrical drying rollers having at least two rollers each having an axis and a circumferential surface, the separate webs being guided at said guide roller into superposed, touching relationship as a single textile web and said rollers of said additional group of drying rollers being disposed downstream of said guide roller for promoting drying said single textile web.

9. In a textile machine, the web drying apparatus according to claim 1 and further comprising a group of cylindrical end drying rollers for end drying of the textile web, uppermost ones of said end drying rollers each having an axis generally positioned in said first roller plane.

10. In a textile machine, the apparatus according to claim 1 wherein the textile machine includes a pre-wetting separating means for separating the textile web into a pair of webs at a location upstream of the wetting means relative to the direction of travel of the textile web and a second pair of squeezing rollers forming a nip therebetween, the wetting means being operable to individually wet each one of the pair of webs and one of the pair of webs traveling through the first pair of squeezing rollers following wetting of the one web and the other of the pair of webs traveling through a second nip formed by the other pair of squeezing rollers following wetting of the other web, and said first and second group of drying rollers are operable to promote drying of the one web following wetting thereof and further comprising a third group of cylindrical drying rollers and a fourth group of cylindrical drying rollers, each of said third and fourth groups of drying rollers having at least two rollers each having an axis and a circumferential surface, each roller of said third and fourth groups of drying rollers being operable to promote drying of the other web following wetting thereof as the other web travels in trained relation around the circumferential surface of the roller, the axes of the two rollers of said third group of drying rollers being disposed in a third roller plane and the axes of the two rollers of said fourth group of drying rollers being disposed in a fourth roller plane, said third and fourth roller planes being in non-parallel relation to one another, the rollers of said third group of drying rollers being disposed on one respective side of a second reference plane which extends parallel to the second nip of the other pair of squeezing rollers through which the other web travels and the rollers of said fourth group of drying rollers being disposed on the other respective side of said second reference plane, said second reference plane being inclined upwardly relatively to the second nip and one roller of at least one of said third and fourth groups of drying rollers being disposed for initially engaging the other web following its travel through the second nip and prior to its travel around the other rollers of said at least one of said third and fourth groups of drying rollers, said initially engaging roller of said third and fourth groups of drying rollers being arranged relative to the second nip such that the circumferential location at which the other web engages said initially engaging roller of said third and fourth groups of drying rollers is disposed upwardly of the second nip.

11. In a textile machine, the web drying apparatus according to claim 10 and wherein each of said groups of drying rollers includes an initially engaging roller for initially engaging a web prior to travel of the web around the other rollers of the respective group of drying rollers and further comprising by first means for separating the one web into another pair of webs at a first separating location between the first nip and said initially engaging rollers of said first and second groups of drying rollers for subsequent travel of each one of the another pair of webs onto a respective one of said initially engaging rollers of said first and second of drying rollers and second means for separating the other web into a further pair of webs at a second separating location between the second nip associated with said third and fourth groups of drying rollers and said initially engaging rollers of said third and fourth groups of drying rollers for subsequent travel of each web of said further pair of webs onto a respective one of said initially engaging rollers of said third and fourth groups of drying rollers, whereby the pair of webs each travel upwardly from the respective nip through which it passes to the respective separating location at which it is separated into said another pair of webs or said further pair of webs and thereafter each of the four webs of said another pair of webs and said further pair of webs travels from its respective separating location to its associated initially engaging roller for drying of the web by a respective one of said groups of drying rollers.

* * * * *